United States Patent [19]

Oelrich

[11] 4,133,155

[45] Jan. 9, 1979

[54] JOIST STRUCTURE

[76] Inventor: Lee D. Oelrich, P.O. Box 3411, Blue Jay, Calif. 92317

[21] Appl. No.: 811,340

[22] Filed: Jun. 29, 1977

[51] Int. Cl.[2] ..... E04C 3/292

[52] U.S. Cl. ..... 52/372; 52/376; 52/729

[58] Field of Search ..... 249/18; 52/376, 729, 52/710, 463–465, 372–375

[56] References Cited

U.S. PATENT DOCUMENTS 2,182,015 12/1939 Davis ..... 52/376

FOREIGN PATENT DOCUMENTS 209483 7/1957 Australia ..... 52/463

*Primary Examiner*—James L. Ridgill, Jr.
*Attorney, Agent, or Firm*—Jessup & Beecher

[57] ABSTRACT

A joist structure having a configuration useful for constructing concrete-forming structures. The joist is comprised of an upwardly opening channel and an oppositely facing downwardly opening keyhole-shaped channel. The joist is an extruded elongate member having the respective channel end walls abutting each other. The upwardly facing channel has a generally rectangular form with the side walls being considerably wider than the end walls to accommodate standard wooden beam sizes, such as a 2 × 4. The downwardly facing channel, somewhat narrower and shorter than the upwardly facing channel, has a keyhole shape which considerably increases the compressive and torsion strength of the overall joist. The keyhole shape also accommodates keyhole-shaped inserts for strengthening the joist at high stress points, such as bearing surfaces and the mid-point between spans. The keyhole-shaped inserts can be provided in varying lengths according to the need and can incorporate mounting holes for the joist.

13 Claims, 13 Drawing Figures

JOIST STRUCTURE

BACKGROUND OF THE INVENTION

This invention relates to improvements in construction elements and more particularly relates to improvements in the structure of a joist.

In the construction of concrete buildings, joists are used to produce concrete forms for poured concrete floors and concrete pillars. The concrete-forming structures are constructed from a plurality of parallel joists spaced according to the weight distribution of the poured concrete having wooden nailers to which plywood forms are attached. These forms are held in position by a metal pipe framework and a concrete floor poured over the plywood. After the concrete hardens, the forms are stripped away by removal of the metal pipe framework. The joists and plywood are reconstructed into forms for pouring succeeding floors, unless damaged or cut to selected lengths preventing their re-use.

One type of beam used for producing concrete forms has a square cross-sectional channel into which a non-standard lumber side is inserted for use as a nailer. The use of this non-standard size has a number of disadvantages. One disadvantage is that the nails for attaching the plywood to the joist for constructing the form typically have to be hammered in at an angle creating some problems in stripping away the concrete forms as well as providing uneven surfaces in the concrete structure which must later be ground off. Another disadvantage is that they do not have sufficient strength and cannot be extended past the ends of the beam for use as a load-carrying member, forcing the compromise in their use. The bottom half of the beam has a bolt slot joined to the channel at the opposite end by a thin web. This configuration provides no method for increasing the bearing or point loads of the beam. This also does not readily permit the use of any method for attaching two or more beams together to form extensions. The thin web also offers little stability against overturning action or pressures. This type of beam is also difficult to work with to accommodate job condition size requirements. It is intended that the beams be reused and not discarded and the cutting of these beams to size defeats the purpose of their use. The prior art beams in order to produce large size concrete forms must be staggered on an intermediate stringer beam because of the lack of ability for abutting adjacent lengths.

SUMMARY OF THE INVENTION

The purpose of this invention is to provide a joist structure which has great strength and versatility.

The present invention is a structural member having a cross-sectional shape adapted for standardized use with standard lumber sizes and other structural members. The beam has a cross-sectional shape in which an upwardly facing rectangular channel abuts a downwardly facing keyhole-shaped channel. The upwardly facing channel has a substantially or generally rectangular shape preferably standardized to standard lumber sizes such as 2 × 4s. The downward facing channel is somewhat smaller and narrower and has a keyhole shape for insertion of a keyhole-shaped solid insert for increasing the beam or joist strength at selected stress points. The height and size of the flanges is also preselected to accommodate standard lumber sizes. For example, the outward extending flanges adjacent to the opening of the rectangular upward facing channel has an overall width of approximately 3½ inches, while the bottom flanges adjacent to the keyhole-shaped slot opening provides a 4½ inch width. The 3½ inch top width allows inversion of the beam for use as a stringer beam or truss in conjunction with a 4 inch standard U-head. The height of the beam being selected at approximately 5½ inches allows use with a standard 2 × 6.

A solid extruded keyhole-shaped insert or filler is provided for strengthening the joist at preselected points. These points would consist of bearing points where the joist rests on stringer beams or trusses and the mid-point of wide spans where high bending strength is needed. The circular portion of the keyhole shape provides even distribution of the stresses giving great strength to the beam. Also the keyhole-shaped solid inserts can be cut to preselected lengths allowing use only at those points where increased strength is desired. A short length of a keyhole insert will be provided at bearing points while a somewhat longer length may be needed at points of high bending stress. With these keyhole-shaped inserts the strength-to-weight ratio is greatly increased. The potential weak points in the joist because of high stress are strengthened, while the amount of weight added for the purpose of strengthening is considerably reduced.

An additional advantage of using they keyhole-shaped inserts is that they can be used as fasteners for attachment of various and sundry types of devices. For example, they may have threaded holes for attachment of clamps or clips or even have slotted tongues for attachment by wedge-shaped members.

The keyhole-shaped channel is also provided with a lip at its opening to permit use of this channel as a bolt head slot for attachment to other beams for constructing wall or floor forms. By inverting the joist structure the bolt head slot can be used with a nut or a clip for securing a joist and creating a joist-truss support.

It is one object of the present invention to provide an improved joist structural element.

It is another object of the present invention to provide an improved joist structure which can accommodate standard lumber sizes.

Another object of the present invention is to provide an an improved joist structure which can function as a stringer or truss.

Yet another object of the present invention is to provide an improved joist structure which can accommodate standard 2 × 4s for a nailer.

Yet another object of the present invention is to provide an improved joist structure having a preselected channel shape for accommodating fillers or inserts at high stress points.

Yet another object of the present invention is to provide an improved joist structure having a keyhole-shaped channel for improved strength and versatility.

Yet another object of the present invention is to provide an improved joist structure having flange widths for utilization with standard lumber sizes.

Other objects, advantages and novel features of the invention will become apparent from the following detailed description of the invention when considered in conjunction with the accompanying drawings wherein like reference numbers identify like parts throughout.

DETAILED DESCRIPTION OF THE PREFERRED EMBODIMENT

Figure 1:
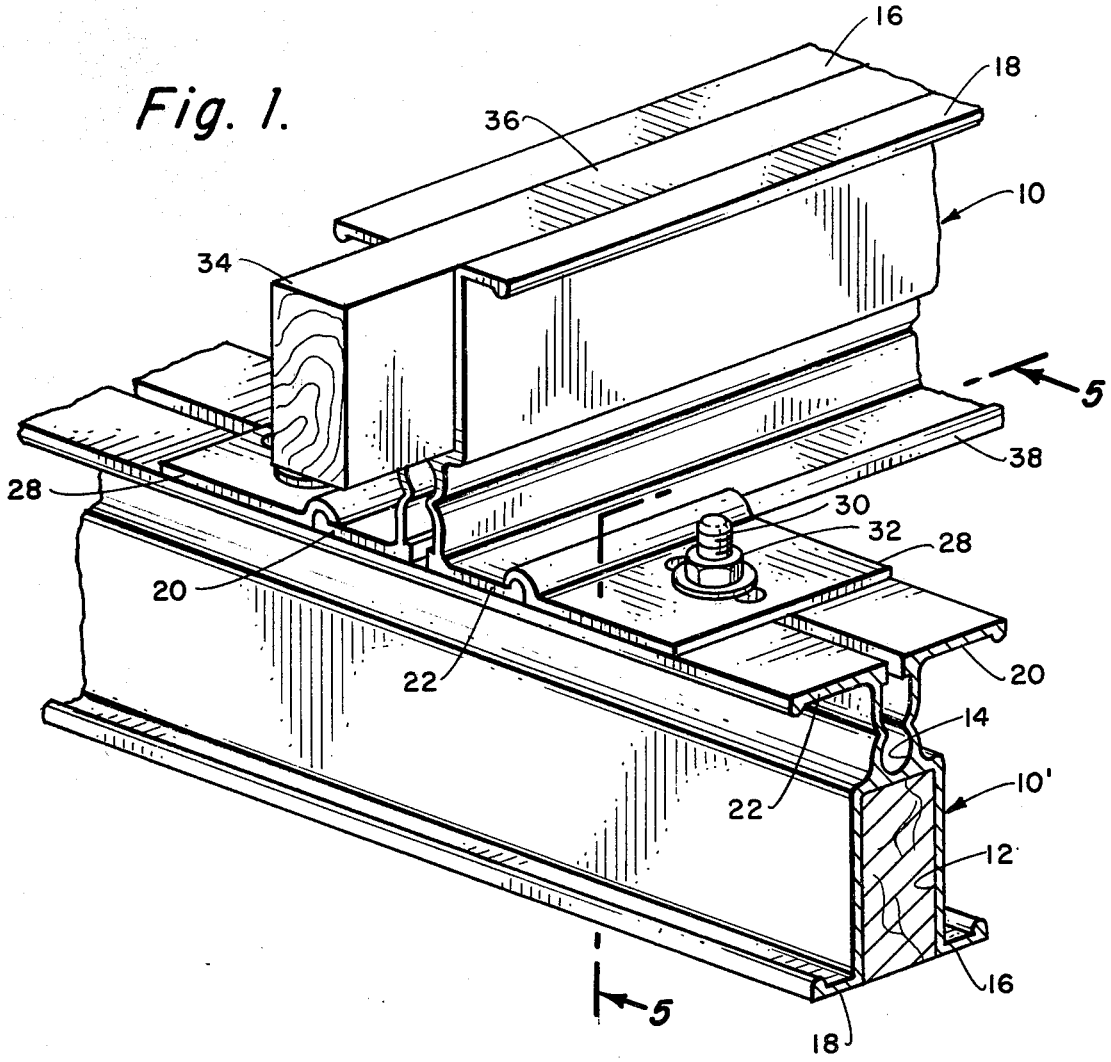
FIG. 1 is a perspective view of the joist structure of the invention and illustrating its versatility.
Figure 2:
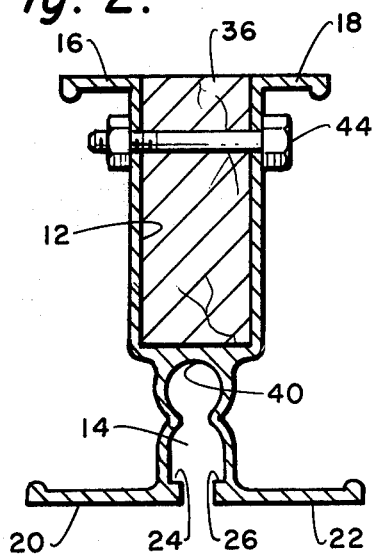
FIG. 2 is a sectional view of the joist structure illustrating its unique shape.

Referring now to FIG. 1, the joist structure 10 is shown being used as a joist and also as a truss or stringer beam 10'. The joist structure is preferably of extruded aluminum and has a cross-sectional area having a generally rectangular channel 12 and a keyhole-shaped channel 14 (FIG. 2). At the open end of the rectangular channel are flanges 16 and 18, while at the opposite end the keyhole-shaped channel terminates in flanges 20 and 22. Adjacent to the mouth of the keyhole channel 14 (FIG. 2) are lips or shoulders 24 and 26 for accommodating bolt heads or nuts. In FIG. 1 the structure 10 illustrates the use of the member as a joist, while the structure 10' illustrates its use in an inverted fashion as a stringer beam or truss. The joist 10 is secured to the truss 10' by bolting with clips 28 on either side of the beam. The bolt 30 (FIG. 5) engages the lips 24, 26 in the keyhole slot, and is secured by a nut 32.

The relative width of the flanges 16, 18, 20, 22, the height between respective flanges (e.g. 16 to 20), and the dimensions of the rectangular channel 12 are all selected to accommodate standardized equipment and lumber. For example, the preferable size of the channel 12 is that which will accommodate a standard 2 × 4. This permits an extension 34 of the 2 × 4 beyond the length of the beam 10 for use as a load-carrying member, if desired. All of the respective flanges 16, 18, 20 and 22 are provided with a rolled edge 38 for engagement with a fastening clip 28 or any other type of clamping device.

Figure 3:
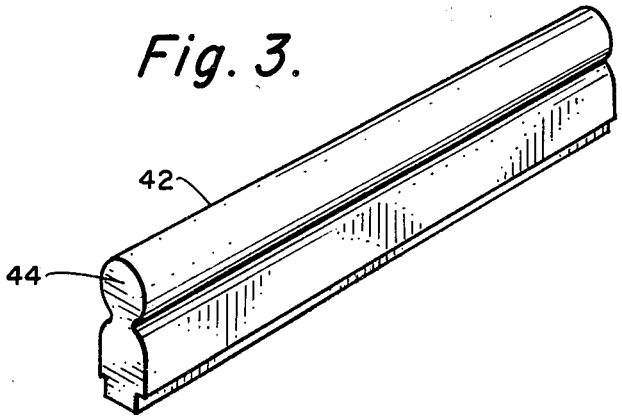
FIG. 3 is a perspective view of a keyhole-shaped insert for use with the joist structure.

A unique feature of this joist structure is the keyhole-shaped channel 14 which not only increases the versatility of the structure, but also provides great strength. The cross-section of the keyhole-shaped channel 14 illustrated in FIG. 2 shows a substantially circular upper portion 40 ending in a pair of inwardly extending curved ribs or ridges 15. The channel 14 then continues to extend downward, terminating in a pair of opposite inwardly extending shoulders or lips 24, 26 at the opening of the channel. The semi-cylindrical portion or arch 40 of the keyhole shape provides high compressive strength to the joist as well as interlocking with a solid keyhole-shaped insert 42, illustrated in FIG. 3. This insert can also be an extruded aluminum shape which can be cut to various sizes and formed into various configurations for use with the joist 10. The cylindrical head 44 of the keyhole insert matches the cylindrical cavity or arch 40 of the keyhole channel and evenly distributes the compressive forces, such as when the joist is used as a concrete-forming structure.

Figure 4:
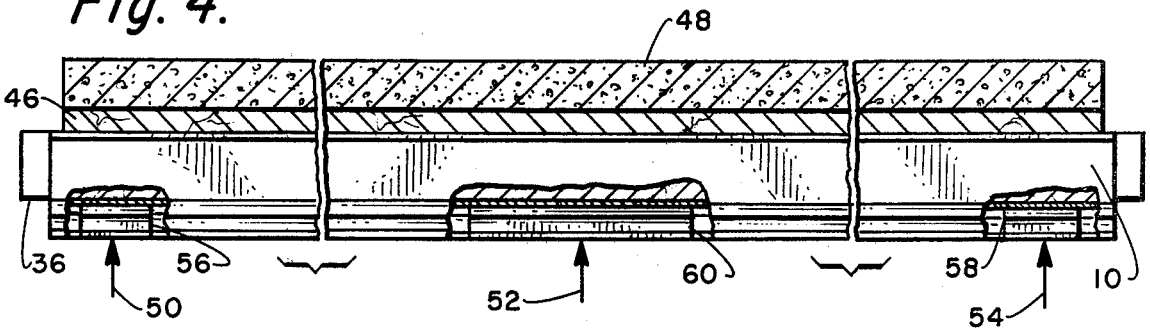
FIG. 4 illustrates the use of the joist structure with keyhole inserts at preselected stress points.

The use of the keyhole insert is illustrated in FIG. 4 in which the structure 10 is shown in use as a joist. The joist 10 has the wooden nailer 36 secured by bolts 44 in the channel 12 and has plywood 46 nailed to the wood insert 36. Concrete 48 is then poured on top of the plywood creating stress points at points 50, 52 and 54, illustrated by the arrows. The end points 50 and 54 will be the bearing points where the joists rest on a truss or stringer beam, while the points 52 will be the center point of a span where the greatest bending moment stress will occur. To provide increased strength in these areas, solid keyhole-shaped inserts 56, 58 and 60 can be provided. At the bearing points 50 and 54, short lengths of the keyhole-shaped insert 42 are sufficient, while the insert 60 may be substantially longer, depending upon the load to be placed on the joist and the space to be spanned. This type of keyhole insert and keyhole slot can considerably reduce the strength-to-weight ratio as reinforcement is generally needed only at the points of great stress.

Figure 5:
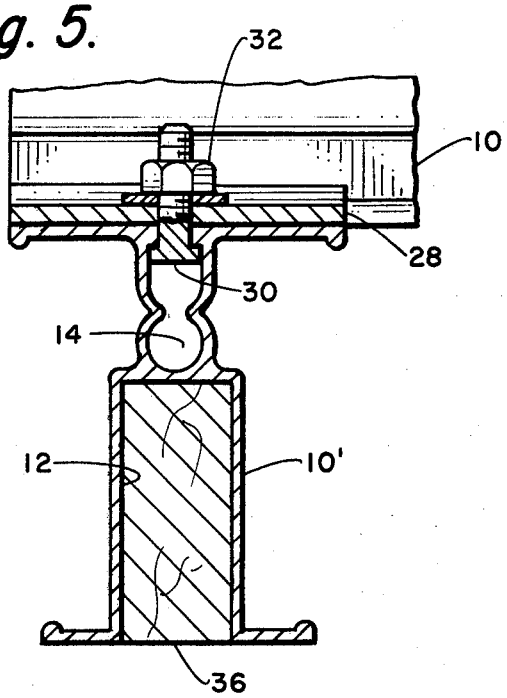
FIG. 5 is a sectional view taken at 5—5 of FIG. 1.
Figure 6:
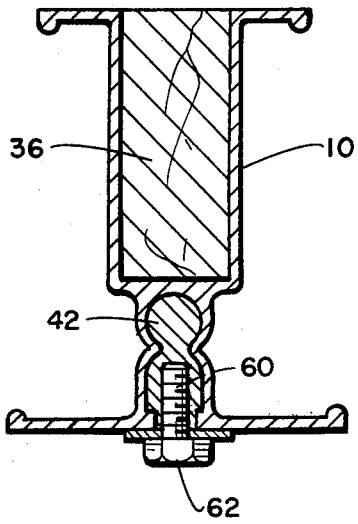
FIG. 6 is a sectional view of the joist structure illustrating a method of clamping the keyhole insert and a variation of the use in mounting.
Figure 7:
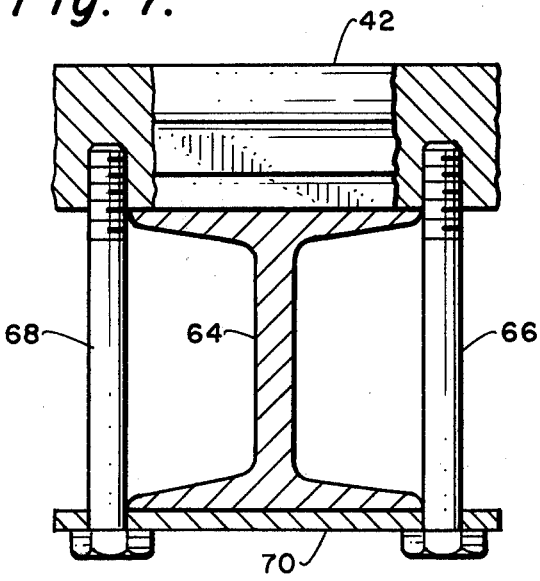
FIG. 7 is another partial sectional view illustrating the use of the keyhole insert for mounting of the joist structure.

In addition to providing great strength to the joist structure, the keyhole-shaped insert can also be used as a fastening member, as illustrated in FIGS. 6 through 10. In FIG. 6 the keyhole insert 42 has a threaded hole 60 for fastening by a bolt 62 to securely clamp the keyhole insert 42 in place and can also function to secure the joist to other beams and joists. Thus, the keyhole insert 42 can be used to attach clips 28, as shown in FIGS. 1 and 5, or to fasten around an I-beam, as illustrated in FIG. 7. In FIG. 7 an I-beam, used as a truss or stringer beam 64, would be fastened to the joist 10 by bolts 66 and 68, securing a plate or clamp 70 around the I-beam.

The keyhole insert 42 would sustain substantially all the bearing point stress of the I-beam 64, in addition to providing means for securing the joist to the beam.

Figure 8:
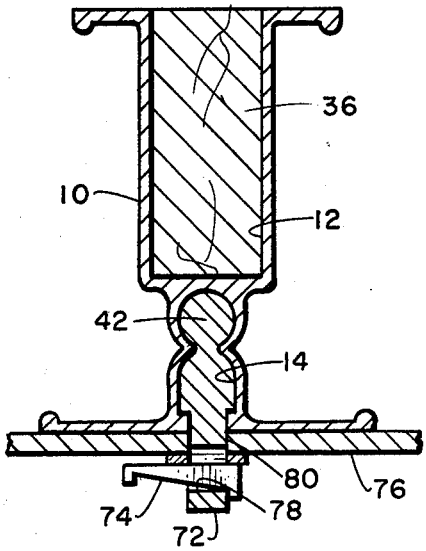
FIG. 8 is a partial sectional view illustrating another variation of the keyhole insert for mounting purposes.
Figure 9:
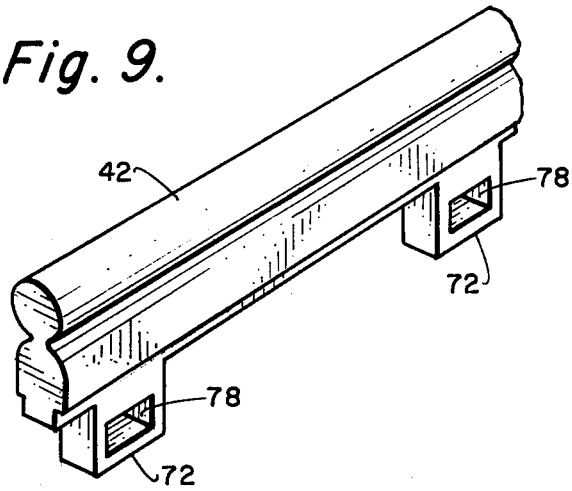
FIG. 9 illustrates a configuration of a keyhole insert for use as a mounting member as illustrated in FIG. 8.
Figure 10:
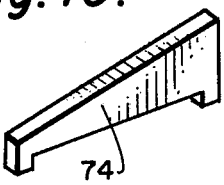
FIG. 10 illustrates a wedge insert for use with a keyhole insert of FIG. 9.

In FIG. 8 the keyhole insert 42 is illustrated with a wedge fastener. The keyhole insert 42 would have a tongue 72 and a slot 78 for insertion of a wedge 74, as illustrated in FIGS. 9 and 10. The insert could have a long flange with several slots 78, or could have selected tongues 72 at various points. The tongue 72 would fit through a slot or hole 80 in a beam 76 to which the joist tends to be attached, and the web 74 driven through the slot 78 in the tongue 72. This would provide an easy to assemble and quick disconnect feature for the system.

Figure 11:
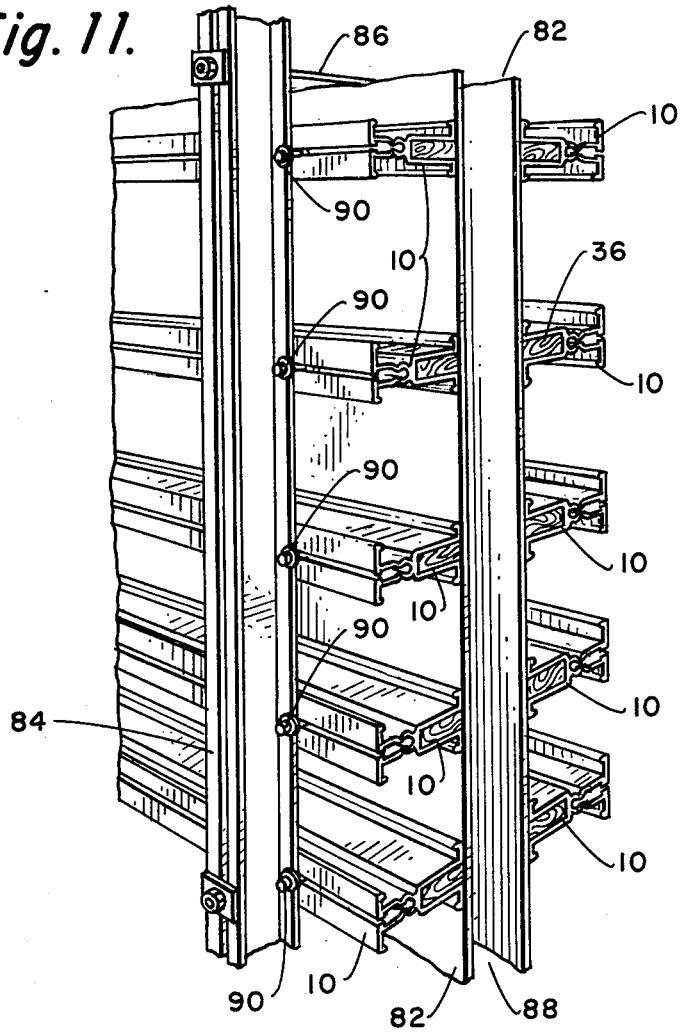
FIG. 11 is a partial perspective view illustrating the use of the joist structure in a wall form.

The joist structure is illustrated in FIG. 11 in use for a wall form. The joist 10 having plywood nailers 36 to which plywood 82 is nailed are arranged horizontally and fastened to a strongback or stiffener 84. A second strongback or stiffener, (not shown) is secured to the opposite side of the wall form and fastened by ties 86. The strongbacks 84 are spaced along the wall form at predetermined distances. The joists 10 are bolted at 90 to the strongbacks 84. This fastening arrangement can be by bolts threaded into keyhole inserts or by bolt heads having nuts as shown in FIG. 5, if desired, or by the wedge fastening method of FIG. 8.

Figure 12:
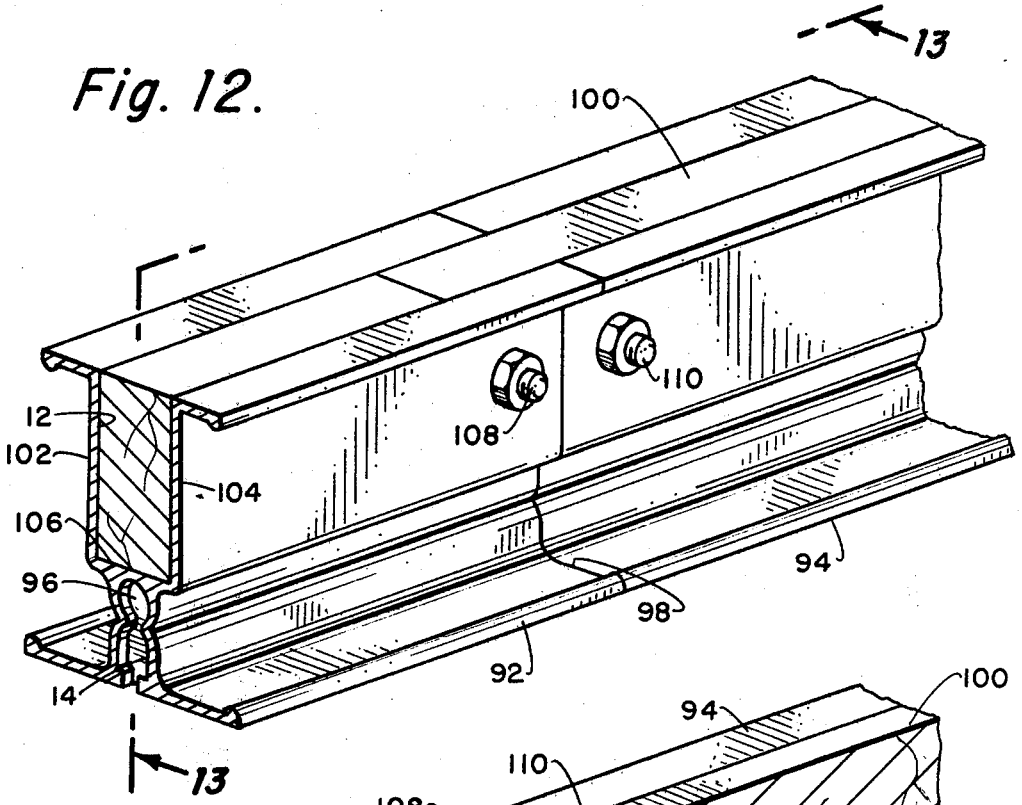
FIG. 12 is a perspective view illustrating the use of the joist structure in an end-to-end configuration for extensions.
Figure 13:
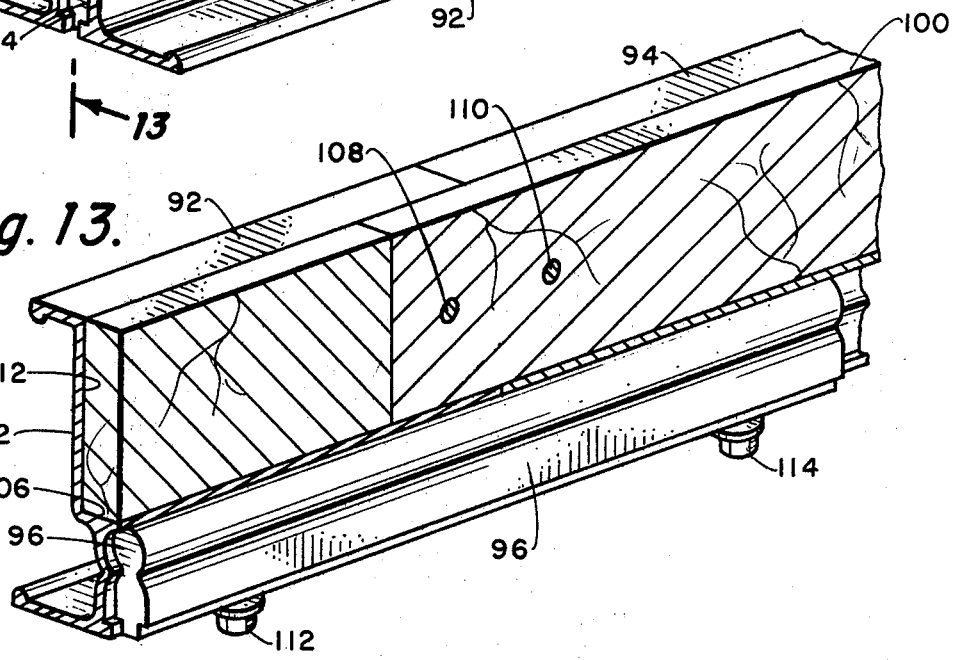
FIG. 13 is a sectional view taken at 13—13 of FIG. 12.

The use of the joist 10 in end-to-end alignment for extensions is illustrated in FIGS. 12 and 13. In FIG. 12 two beams 92 and 94 would be placed end to end with the rectangular channels 12 and keyhole-shaped channel 14 in alignment. In this configuration a keyhole insert 96 can be inserted in the channel 14 providing great strength at the joint 98, as well as securely aligning the two joists. In addition to the use of the strengthening keyhole-shaped insert 96, a wood nailer 100 in the rectangular channel 12 having side walls 102 and 104 longer than end wall 106 can extend beyond the end of the beam 94 into the adjacent channel for fastening the two beams or two joists 92 and 94 in end-to-end relationship. The keyhole insert 96 not only aligns and joins the two beams or joists 92 and 94, but also provides great compressive strength at the joint 98. Bolts 108 and 110 through the 2 × 4 100 can securely fasten the two beams together. Bolts 112 and 114, with suitable washers, securely clamp the keyhole insert 96 in place in a manner shown in FIG. 6, maintaining the beams 92 and 94 in end-to-end relationship.

Thus, there has been disclosed a unique structural shape for a joist or beam which provides great strength and versatility. The dimensions of the flanges can accommodate standardized U-heads and jacks while the height between the flanges can accommodate standardized lumber sizes such as 2 × 6s. In addition, the rectangular upwardly facing channel can accommodate standardized lumber and the downwardly somewhat shorter and narrower keyhole-shaped channel can provide for improved strength in high-stress points. The ability to join these beams end to end allows precut lengths to be used over and over as well as permitting easy assembly and disassembly of concrete forms.

Obviously many modifications and variations of the present invention are possible in light of the above teachings. It is therefore to be understood that the full scope of the invention is not limited to the details disclosed herein and may be practiced otherwise than as specifically described.

What is claimed is:

1. Joist for concrete forms and the like comprising:

an elongate beam comprising a pair of outward facing, opposite channels having a common end wall;

one of said channels having a cross-section in the form of a keyhole having a substantially circular upper portion ending in a pair of inwardly extending curved ridges and then extending downward to terminate in a pair of opposite inwardly extending shoulders;

the other of said channels being of rectangular cross-section whereby an elongate wooden nailer may be located in said other channel thereby to provide a mounting surface for nailing a concrete form sheet thereto.

2. Joist according to claim 1 including:

outwardly extending flanges along each side of said outward facing opposite channels;

said flanges having a rolled lip along their outermost edge for engaging clips to clamp said joist securely to a structure.

3. Joist in accordance with claim 1 including at least one elongate strengthening insert having a cross-section the same as that of said one channel, positioned in said one channel, and having a length substantially less than the length of said beam.

4. The joist structure according to claim 3 wherein said keyhole-shaped strengthening inserts have threaded holes for securing said beam to a truss for constructing a concrete form.

5. The joist structure according to claim 3 wherein said keyhole-shaped strengthening inserts have one or more slotted, projecting tongues for securing said beams with a wedge.

6. The joist structure according to claim 1 wherein the rectangular-shaped channel has a side wall to end wall width ratio of approximately 2.

7. The joist structure according to claim 6 wherein the rectangular-shaped channel has side wall and end wall dimensions approximately equal to a standard 2 × 4.

8. A concrete construction form comprising:

a plurality of joists according to claim 1 arranged parallel at a predetermined spacing;

wooden filler means filling said rectangular-shaped channel;

wooden forming means supported on said joists and secured by nailing to said filler;

a pair of trusses transversely supporting opposite ends of said joists;

fastening means fastening said joists to said trusses thereby forming a concrete-forming structure.

9. The concrete construction form according to claim 8 including:

elongate strengthening inserts having a cross-section the same as that of said one channel, positioned in said one channel at the truss contact bearing points and having a length substantially less than the length of said beam.

10. The concrete construction form according to claim 9 wherein said fastening means comprises:

threaded bolt holes in said keyhole-shaped means spanning said truss;

clamping means clamped around said truss and bolted to said threaded holes in said keyhole-shaped means to secure each of said joists to said truss.

11. The concrete construction form according to claim 9 wherein said trusses comprise inverted joists having an elongate beam comprising a pair of outward facing, opposite channels having a common end wall; one of said channels having a cross-section in the form of a keyhole having a substantially circular upper portion ending in a pair of inwardly extending curved ridges and then extending downward to terminate in a pair of opposite inwardly extending shoulders; the other of said channels being of rectangular cross-section whereby an elongate wooden nailer may be located in said other channel thereby to provide a mounting surface for nailing a concrete form sheet thereto.

12. The concrete construction form according to claim 11 including:

elongate strengthening inserts having a cross-section the same as that of said one channel positioned in said one channel of said trusses at the contact bearing point of said joists and having a length substantially less than the length of said beam.

13. The concrete construction form according to claim 9 wherein said fastening means comprises:

threaded bolt holes in said keyhole-shaped means on either side of said joist;

clamping means bolted to said trusses for clamping said joist securely.

* * * * *